US009937738B2

(12) United States Patent
Slomianny et al.

(10) Patent No.: US 9,937,738 B2
(45) Date of Patent: Apr. 10, 2018

(54) ADJUSTABLE INKJET PRINTER FOR THE LABELING OF GOODS

(71) Applicant: EBS Ink Jet Systeme GmbH, Nuembrecht (DE)

(72) Inventors: Jan Slomianny, Nuembrecht (DE); Andreas Slomianny, Nuembrecht (DE)

(73) Assignee: EBS Ink Jet Systeme GmbH (DE)

( * ) Notice: Subject to any disclaimer, the term of this patent is extended or adjusted under 35 U.S.C. 154(b) by 0 days.

(21) Appl. No.: 15/484,491

(22) Filed: Apr. 11, 2017

(65) Prior Publication Data

US 2017/0291437 A1 Oct. 12, 2017

(30) Foreign Application Priority Data

Apr. 12, 2016 (DE) ..... 10 2016 106 682

(51) Int. Cl.

| | |
|---|---|
| ***B41J 29/02*** | (2006.01) |
| ***B41J 2/14*** | (2006.01) |
| ***B41J 3/36*** | (2006.01) |
| ***B41J 25/00*** | (2006.01) |

(52) U.S. Cl.

CPC ..... *B41J 29/02* (2013.01); *B41J 2/1433* (2013.01); *B41J 3/36* (2013.01); *B41J 25/003* (2013.01)

(58) Field of Classification Search

CPC ... B41J 29/02; B41J 2/1433; B41J 3/36; B41J 25/003

See application file for complete search history.

(56) References Cited

U.S. PATENT DOCUMENTS 7,434,900 B2 10/2008 Slomianny et al.
2008/0198210 A1* 8/2008 Umeda ..... B41J 2/17513 347/86

FOREIGN PATENT DOCUMENTS

EP 1064153 B1 8/2003
EP 2279971 A2 * 2/2011 ..... B41J 2/175

* cited by examiner

*Primary Examiner* — Lamson Nguyen
(74) *Attorney, Agent, or Firm* — McCarter & English, LLP

(57) ABSTRACT

Inkjet printer for the labeling of goods having a print head having a cylindrically shaped housing. A latching lug, and a circumferentially extending groove are formed on the housing in a rear region thereof, in the vicinity of a rear face of the housing. Further, it has an annular collar having an inner wall adapted to the housing. On the one hand, the housing is capable of being fixed and, on the other hand, it is rotatable and axially movable, relative to the annular collar. The annular collar has a bore hole axially aligned with the groove, and a fixing projection located in the bore hole. Further, it has several latching recesses for the latching lug. When the latching lug is positioned in one of the latching recesses, the bore hole is located radially above the groove.

17 Claims, 1 Drawing Sheet

ADJUSTABLE INKJET PRINTER FOR THE LABELING OF GOODS

This application claims priority under 35 U.S.C. §§ 119 (a)-(d) to German application no. DE 10 2016 106 682.6 filed Apr. 12, 2016, which is hereby expressly incorporated by reference as part of the present disclosure.

FIELD OF INVENTION

The invention relates to an inkjet printer for the labeling of goods. The inkjet printer has a print head in whose cylindrically delimited housing at least one outlet opening for ink droplets is located on a front face; usually, a line of outlet openings is provided. Furthermore, the print head has a printing mechanism which, controlled by a control system, lets ink escape from the outlet openings so that a desired printed image is obtained. Most frequently, a pump for the liquid of the ink droplets, which supplies the printing mechanism with ink, is also provided in the print head. A filter for the liquid of the ink droplets is often also disposed in the print head.

BACKGROUND

The invention relates, in particular, to such inkjet printers in the form of stationary devices. They are generally externally supplied with voltage, e.g. via the normal power grid. The goods are moved past the stationary device; for example, they are located on a conveyor belt. However, the invention also relates to inkjet printers in the form of handheld devices, see, e.g., European Patent No. EP 1 064 153 B1. They are capable of being moved relative to stationary goods to be labeled.

Such print heads should be orientated towards the goods that are moved past them. For this purpose, stands are usually used; the print head is attached to a stand and orientated such that the desired printing result on the goods is obtained. Sensors are provided, that respectively detect when goods are positioned in the printing area of the print head; the printing process is started in this manner. These sensors are also usually attached to the stand.

SUMMARY OF THE INVENTION

There is a desire to be able to orientate the print head not only spatially by means of the stand, but also in certain angular positions. This is where the invention comes in. It has set itself the task of achieving an angular positioning of the print head without the spatial orientation by means of the stand and towards the goods to be labeled being affected.

This object is achieved by an inkjet printer for the labeling of goods with a print head having a cylindrically delimited housing, a latching lug and a circumferentially extending groove formed on the housing near a rear face, and an annular collar having a cylindrically delimited inner wall adapted to the housing and gripping around the housing, wherein the housing is, on the one hand, capable of being fixed and, on the other hand, rotatable and axially movable relative to the annular collar, the annular collar comprising a) a connection for a stand, b) a bore hole on the axial level of or axially aligned with the groove, which bore hole extends in the radial direction in the annular collar, c) a fixing projection located in the bore hole and having a head located outside an outer shell of the annular collar, and d) several latching recesses for the latching lug, which latching recesses have a zero-degree latching recess and several angle latching recesses disposed in predefined angular positions next to the zero-degrees latching recess, wherein, when the latching lug is located in one of the latching recesses, the bore hole is located radially above the groove.

The cylindrically shaped print head is held and gripped by the annular collar. The annular collar has a cylindrically delimited inner space into which the housing of the print head fits. The housing of the print head has at least partially cylindrical surfaces; the other surfaces of the housing are situated within the cylinder shell delimiting the cylindrical housing. The annular collar is preferably a section of a round pipe. Axially, it is significantly shorter than the housing; for example, it has at most half the length of the housing.

The print head is axially movable and rotatable within the annular collar. It can be fixed in any position relative to the annular collar; on the one hand, the cooperation of one of the latching recesses and the latching lug, and on the other hand, the cooperation of the groove and the fixing projection serve this purpose, whereby a position of the latching lug in a selected latching recess is fixed. The groove ensures that the axial position of the print head relative to the annular collar can remain unchanged after a rotation of the print head relative to the annular collar. In this case, the annular collar retains the print head only in one of the predefined positions, i.e. in a position in which the latching lug has engaged into one of the latching recesses. However, it is to be expressly emphasized here that the structure makes it possible, in principle, to fix the print head in the annular collar even without a cooperation of the latching lug with one of the latching recesses, i.e. when the fixing projection is located axially in front of the groove, and thus at a greater distance from the rear face, than the groove. In that case, any angular position is possible, also outside the predefined positions of the latching recesses. The housing of the print head is fixed by means of the fixing projection, be it in a manner cooperating with the groove or spatially in front of the groove.

Defined angular positions are prescribed by the several latching recesses. They are reproducible. They are, for example, suitable for different fonts, different printing processes etc. For example, an italic font can be set by a slight angular rotation.

The annular collar has a connection for a stand. Usually, a round pipe is used as a stand. The connection is in that case configured as a clamp that grips around the stand pipe and can be fixed, for example by means of a screw.

Brackets may also be disposed on the annular collar, for example for accommodating sensors or for the connecting cables and tubes of the print head. In this way, a precise positioning of at least one sensor for detecting goods and/or of a cable routing is possible.

An advantageous development provides not only a zero-degrees latching recess, rather, a 180° latching recess that is 180° opposite is also formed. Thus, it is possible, for example, to print letters upside down. In particular, however, in cooperation with a deflector, the option is provided that this deflector is located, on the one hand, in front of a line of outlet openings in the printing direction, and after a rotation by 180°, behind a line of outlet openings in the printing direction.

Preferably, the latching recesses are disposed symmetrically. Angle latching recesses, which are associated with certain angle positions, e.g. 10, 15, 30, 45°, are disposed symmetrically to the left and the right of a zero-degrees latching recess. This also applies in one embodiment to a 180° latching recess, which has corresponding latching recesses symmetrically distributed to the left and the right next to it.

An indicating mark, also called indicating means, is associated with each latching recess. Preferably, the latching recesses are provided on one axial end of the annular collar and the indicating means are disposed at the other axial end. The number of the latching recesses preferably corresponds to the number of indicating means.

In some embodiments, an axially extending marking, in particular in the form of a line, is provided on the outer wall of the housing. This line can extend over a major part of the axial length of the housing; preferably it extends over a length greater than the axial length of the annular collar. This marking is aligned with one of the indication means, i.e. the indicating means whose associated latching recess is engaged with the latching lug.

In some embodiments, the latching lug is tooth or pin-shaped and protrudes in the axial direction. It extends axially over a few millimeters, e.g. 3 to 12, in particular 8 mm. The latching recesses are configured accordingly; they accommodate the latching lug substantially without clearance. The latching lug may have a tip or inclined portion in its foremost region, so that an insertion into a latching recess is facilitated.

BRIEF DESCRIPTION OF THE DRAWINGS

Other advantages and features of the invention become apparent from the other claims as well as from the following description of two exemplary embodiments of the invention, which shall be understood not to be limiting and which will be explained below with reference to the drawing. In the drawings:

DETAILED DESCRIPTION

Figure 1:
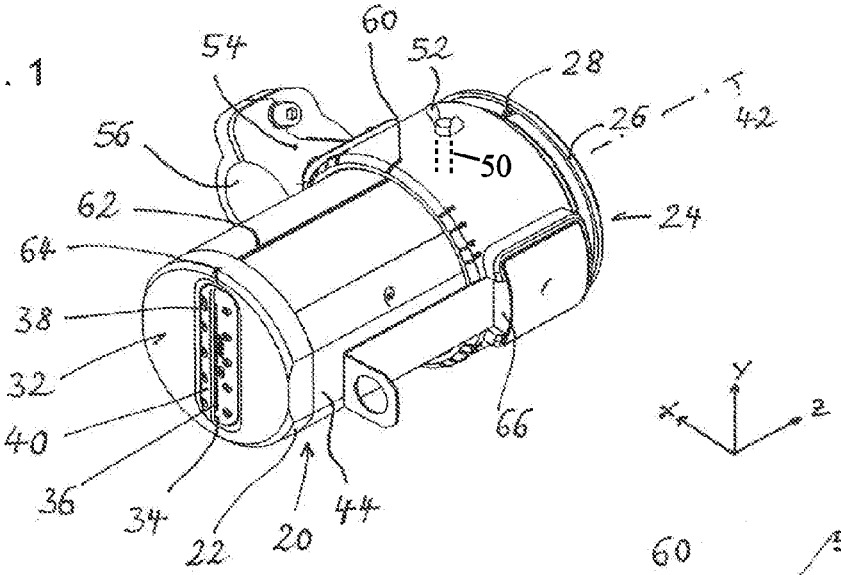
FIG. 1 shows a perspective view of the inkjet printer with a print head and an annular collar.
Figure 2:
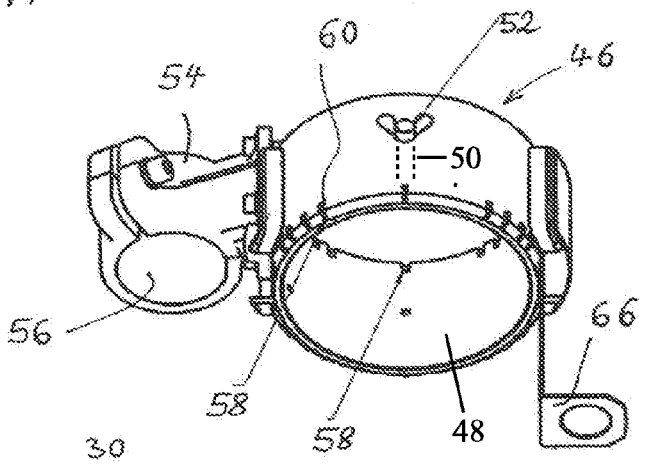
FIG. 2 shows a perspective view of the annular collar.
Figure 3:
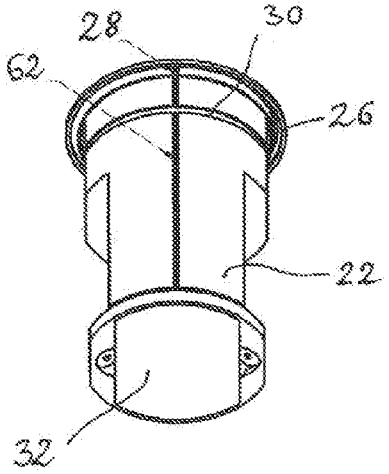
FIG. 3 shows a perspective view of another embodiment of a print head with an oblique view from above onto a front face, without, however, a front closure cap with outlet openings and a deflector.

Referring to FIGS. 1-3, the inkjet printer has a print head 20 having a substantially cylindrically delimited housing 22. More specifically, this housing 22 is delimited in such a manner that it fits within a cylindrical cavity. It can be rotated and axially moved within this cylindrical cavity. However, the housing 22 has on a rear surface 24 a projection or protrusion 26, configured as a flange in the illustrated embodiment, which protrudes radially over the above-described cylindrical cavity. A latching lug 28, which extends from the rear face 24 towards the front in the axial direction, emerges from this protrusion 26. Preferably, the latching lug 28 is connected to the cylindrical part of the housing 22, so that it does not protrude freely all around but remains connected to the housing 22 on one side.

The housing has a circumferentially extending groove 30 (shown in FIG. 3), which has a width of a few millimeters in the axial direction and a depth of a few millimeters, e.g. 2 to 5 mm.

On front face 32 of the housing 22, a line 34 of outlet openings 36 for ink is formed. This line 34 is formed by a component 38 that realizes a deflector 40 at the same time. The latter has a saw tooth-shaped profile. It has its greatest thickness and thus the greatest distance from the outlet openings 36 in the immediate vicinity of the line 34; the thickness decreases as the distance from the line 34 increases, in the positive x-direction in FIG. 1.

A right-handed x-y-z coordinate system is used for the description. The z-axis extends parallel to an axis 42 of the housing 22. The line 34 extends parallel to the y direction. The x-direction extends parallel to the printing direction. Specifically, the arrow of the x-direction is either directed in the printing direction or 180° in the direction opposite thereto.

The housing 22 has flattened portions 44 that are recessed from the cylindrical shape.

The housing 22 is gripped by an annular collar 46; the latter is also referred to as retainer sleeve. It has a cylindrically delimited inner wall 48 adapted to the housing 22, which rests against the housing 22 in a more or less accurately fitting manner. The annular collar 46 can be displaced relative to the housing 22 in the z-direction. Moreover, it is rotatable in the circumferential direction relative to the housing 22. A fixing means is provided in order to fix the housing 22 in the annular collar 46. For this purpose, the annular collar 46 has a bore hole 50 that extends in the radial direction and receives a fixing projection 52 that is detachable and can be fixed. Specifically, the bore hole 50 is formed as a threaded bore hole; the fixing projection 52 is configured as a female thread and has a head in the shape of a wing nut. By tightening the fixing projection 52 the print head 20 can be fixed in the annular collar 46.

In some embodiments, the fixing projection 52 engages into the groove 30. The latter is axially positioned accordingly, as will be described further below.

A connection part 54 for a stand is located on the annular collar 46. The stand is part of the prior art and is not illustrated in more detail herein. The connection part may protrude radially outwards from the annular collar 46 and has an annular clamp 56, which is able to grip around a round stand pipe not shown here and which can be attached thereto by means of a clamping screw.

The annular collar 46 has a plurality of latching recesses 58 that are adapted to the latching lug 28 with regard to their shape and accommodate the latter substantially without clearance. For this purpose, the latching lug 28 is aligned with one of the latching recesses 58 by rotating the housing 22, and then the housing 22 is moved axially so that the latching lug 28 can be pushed into the selected latching recess 58. If this state is reached, the bore hole 50 is located above the peripherally extending groove 30. Thus, the fixing projection 52 is able to engage into the groove 30.

The arrangement of the latching recesses 58 is arbitrary. In the specific exemplary embodiment, a zero-degrees latching recess and a 180° latching recess 58 diametrically opposite thereto are provided. To the left and to the right thereof, respectively, symmetrically disposed angle latching recesses are located, which are positioned at an angle of, for example, 10, 15, 25, 30, 45 and 90°, wherein a 90° latching recess relative to the zero-degrees latching recess is, at the same time, also a 90° latching recess relative to the diametrically opposed 180° latching recess. An indicating means 60, which is located in the same circumferential position and is merely axially offset relative to the associated latching recess 58 in the z-direction, is associated with each latching recess 58. Since the latching recesses 58 in the preferred embodiment are formed at the rear end of the annular collar 46 and are hidden by the latching lug 28 in the engaging state of a latching recess 58, the indicating means 60 make the respective angular orientation easily recognizable. A marking 62 on the outer wall of the housing 22 is associated with the indicating marks 60. It extends parallel to the z-direction and extends virtually over the entire length of the print head 20, in any case over more than twice the axial length of the annular collar 46.

FIG. 1 shows the alignment of an indicating marks 60 and this marking 62; in the state shown, the associated latching recess is not in engagement with the latching lug 28. This marking 62 is orientated as follows: The line 34 extends parallel to the y-direction and has a center situated on the axis 42. The line 34 is situated on a straight line intersecting a straight line at 64 on which the marking 62 is located. Thus, in the orientation of the print head 20 and the annular collar 46 shown in FIG.1, the orientation of the print head 20 is such that the print head 20 is in the normal position relative to the annular collar 46; this normal position can also be referred to as the 0° position. If one wishes to position the print head 20 in other angular positions around the axis 42 in the annular collar 46, the print head 20 and the coordinate system associated therewith takes on a different orientation.

A bracket 66 is disposed on the annular collar 46; it is diametrically opposite to the connection part 54. Sensors (not shown) or other accessories can be attached to the bracket 66. The bracket 66 protrudes in the negative z-direction; it protrudes up to the vicinity of the front face 32.

The applicant reserves the right to combine any features, even partial features of the claims, with features from the description. For this purpose, features from parts of sentences can be taken from the description.

Terms like substantially, preferably and the like and indications that may possibly be understood to be inexact are to be understood to mean that a deviation by plus/minus 5%, preferably plus/minus 2% and in particular plus/minus one percent from the normal value is possible.

While the above describes certain embodiments, those skilled in the art should understand that the foregoing description is not intended to limit the spirit or scope of the invention. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. An inkjet printer for labeling of goods, comprising:

a print head having a cylindrically-delimited housing, the housing comprising a rear face, a latching lug, and a circumferentially extending groove, wherein said groove is formed on the housing in a rear portion thereof near the rear face of the housing, and an annular collar having a cylindrically-delimited inner wall adapted to receive and extend around the housing, wherein the annular collar comprises a) a connection for a stand, b) a bore hole extending in a radial direction in the annular collar, c) a fixing projection located in the bore hole having a head located outside an outer shell of the annular collar, and d) a plurality of latching recesses configured to receive the latching lug therein, wherein said latching recesses include a zero-degree latching recess located on the annular collar at a position thereof corresponding to a normal printing position, and a plurality of angle latching recesses disposed at predefined angular positions around a circumference of the annular collar relative to the zero-degree latching recess, wherein, when the latching lug is located in one of the latching recesses, the bore hole is located radially above the groove, wherein the housing is both fixable and rotatable and axially movable relative to the annular collar.

2. The inkjet printer according to claim 1, wherein the angle latching recesses are symmetrically disposed with respect to the zero-degree latching recess.

3. The inkjet printer according to claim 1, wherein the latching recesses are located at a rear axial end of the annular collar, and the annular collar further includes one or more indicating marks each corresponding to a respective one of the latching recesses.

4. The inkjet printer according to claim 3, wherein the number of said latching recesses is equal to the number of said indicating marks.

5. The inkjet printer according to claim 3, wherein the housing defines an outer wall and has a marking thereon extending in the axial direction, wherein the marking is aligned with one of the indicating marks when the latching lug is located in the latching recess associated with that respective indicating mark.

6. The inkjet printer according to claim 1, wherein the bore hole defines a threaded bore hole, and the fixing projection has a screw thread located in the threaded bore hole.

7. The inkjet printer according to claim 1, wherein the annular collar is made from plastic.

8. The inkjet printer according to claim 1, wherein the print head defines a front face with a plurality of outlet openings for ink thereon extending parallel to a y-axis of the print head in a line;

the front face includes a deflector disposed thereon adjacent to the outlet openings and protruding forward in an axial direction relative to the front face to a greater extent than the line of outlet openings;

the front face defines an x-axis extending along the front face transverse to the y axis and parallel to a printing direction of the print head, and the deflector, viewed in a direction of the x-axis, is located adjacent to the line of outlet openings.

9. The inkjet printer according to claim 8, wherein the deflector extends parallel to the line of outlet openings.

10. The inkjet printer according to claim 8, wherein the deflector extends over a length at least corresponding to a length of the line in the direction of the y-axis.

11. The inkjet printer according to claim 8, wherein the deflector and the line of outlet openings are formed together in a one-piece component.

12. The inkjet printer according to claim 1, wherein the print head has an axial length that is at least twice as long as an axial length of the annular collar.

13. The inkjet printer according to claim 1, wherein the housing includes a projection at or near the rear face that protrudes radially and is configured to prevent the annular collar from being pulled off from the housing in a rearward direction.

14. The inkjet printer according to claim 1, wherein the housing has a peripherally-extending flange protruding radially from or near the rear face and configured to prevent the annular collar from being pulled off from the housing in a rearward direction.

15. The inkjet printer according to claim 1, further comprising a bracket attached to the annular collar and protruding from the annular collar in a negative z-direction.

16. The inkjet printer according to claim 1, wherein the plurality of angle latching recesses include a plurality of angle latching recesses that are symmetrically disposed with respect to the zero-degree latching recess and a 180° latching recess that is offset by 180° around the circumference of the annular collar relative to the zero-degree latching recess.

17. The inkjet printer according to claim 1, wherein the latching recesses are located at a rear axial end of the annular collar, and the annular collar further includes indicating marks corresponding in number to the number of latching recesses located at an opposite axial end of the annular collar relative to the latching recesses.

* * * * *